US010711617B2

(12) United States Patent
Naik

(10) Patent No.: US 10,711,617 B2
(45) Date of Patent: Jul. 14, 2020

(54) CASTING METHOD, APPARATUS AND PRODUCT

(71) Applicant: Howmet Corporation, Independence, OH (US)

(72) Inventor: Rajeev Naik, Yorktown, VA (US)

(73) Assignee: HOWMET CORPORATION, Whitehall, MI (US)

( * ) Notice: Subject to any disclaimer, the term of this patent is extended or adjusted under 35 U.S.C. 154(b) by 0 days.

(21) Appl. No.: 16/108,429

(22) Filed: Aug. 22, 2018

(65) Prior Publication Data

US 2019/0032492 A1 Jan. 31, 2019

Related U.S. Application Data

(63) Continuation of application No. 13/998,273, filed on Oct. 17, 2013, now Pat. No. 10,082,032.

(60) Provisional application No. 61/796,265, filed on Nov. 6, 2012.

(51) Int. Cl.

| | |
|---|---|
| ***F01D 5/14*** | (2006.01) |
| ***B22D 27/04*** | (2006.01) |
| ***B22D 25/02*** | (2006.01) |
| ***B22D 30/00*** | (2006.01) |

(52) U.S. Cl.

CPC ..... *F01D 5/147* (2013.01); *B22D 25/02* (2013.01); *B22D 27/045* (2013.01); *B22D 30/00* (2013.01)

(58) Field of Classification Search

CPC ..... F01D 5/147; B22D 25/02; B22D 30/00; B22D 27/045; C22F 1/10

See application file for complete search history.

(56) References Cited

U.S. PATENT DOCUMENTS

| | | | |
|---|---|---|---|
| 2,768,915 | A | 10/1956 | Nachman et al. |
| 3,342,455 | A | 9/1967 | Fleck et al. |
| 3,515,202 | A | 6/1970 | Bick et al. |
| 3,532,155 | A | 10/1970 | Skokie et al. |
| 3,931,847 | A | 1/1976 | Terkelsen |
| 4,573,516 | A | 3/1986 | Quested et al. |
| 4,724,891 | A | 2/1988 | Brookes |
| 4,809,764 | A | 3/1989 | Prasad |
| 5,072,771 | A | 12/1991 | Prasad |

(Continued)

FOREIGN PATENT DOCUMENTS

| | | |
|---|---|---|
| EP | 0749790 | 12/1996 |
| EP | 2727669 | 5/2014 |

(Continued)

*Primary Examiner* — Jessee R Roe

(74) *Attorney, Agent, or Firm* — Greenberg Traurig, LLP

(57) ABSTRACT

A casting method and apparatus are provided for casting a near-net shape article, such as for example a gas turbine engine blade or vane having a variable cross-section along its length. A molten metallic melt is provided in a heated mold having an article-shaped mold cavity with a shape corresponding to that of the article to be cast. The melt-containing mold and mold heating furnace are relatively moved to withdraw the melt-containing mold from the furnace through an active cooling zone where cooling gas is directed against the exterior of the mold to actively extract heat. At least one of the mold withdrawal rate, the cooling gas mass flow rate, and mold temperature are adjusted at the active cooling zone as the melt-containing mold is withdrawn through the active cooling zone to produce an equiaxed grain microstructure along at least a part of the length of the article.

11 Claims, 13 Drawing Sheets

(56) References Cited

U.S. PATENT DOCUMENTS

| | | | |
|---|---|---|---|
| 5,273,101 | A | 12/1993 | Lillquist et al. |
| 5,335,711 | A | 8/1994 | Paine |
| 5,376,915 | A | 12/1994 | Takeuchi et al. |
| 5,577,547 | A | 11/1996 | Hosamani |
| 5,592,984 | A | 1/1997 | Schmiedeknecht et al. |
| 5,611,670 | A | 3/1997 | Yoshinari et al. |
| 5,861,449 | A | 1/1999 | Akimoto et al. |
| 5,921,310 | A | 7/1999 | Kats et al. |
| 6,209,618 | B1 | 4/2001 | Chiang |
| 6,311,760 | B1 | 11/2001 | Fernihough et al. |
| 6,443,213 | B1 | 9/2002 | Graham et al. |
| 6,631,753 | B1 | 10/2003 | Carter, Jr. et al. |
| 6,695,034 | B2 | 2/2004 | Graham |
| 6,769,473 | B1 | 8/2004 | Adachi et al. |
| 6,851,466 | B2 | 2/2005 | Adachi et al. |
| 6,889,747 | B2 | 5/2005 | Graham |
| 6,918,969 | B2 | 7/2005 | Zeze et al. |
| 7,448,428 | B2 | 11/2008 | Graham et al. |
| 7,824,494 | B2 | 11/2010 | Frasier et al. |
| 2003/0141035 | A1 | 7/2003 | Shimohata et al. |
| 2003/0221810 | A1 | 12/2003 | Schlienger et al. |
| 2003/0234092 | A1 | 12/2003 | Brinegar |
| 2005/0103462 | A1 | 5/2005 | Balliel et al. |
| 2008/0014459 | A1 | 1/2008 | Przeslawski et al. |
| 2009/0065169 | A1 | 3/2009 | Chi |
| 2012/0080158 | A1 | 4/2012 | Liu et al. |
| 2013/0022803 | A1 | 1/2013 | Schaeffer et al. |

FOREIGN PATENT DOCUMENTS

| | | |
|---|---|---|
| GB | 1278224 | 6/1972 |
| JP | HEI 02-182343 | 7/1990 |
| JP | HEI 03-094967 | 4/1991 |
| JP | HEI 04-084661 | 3/1992 |
| JP | HEI 10-0859527 | 4/1998 |
| WO | 03033750 | 4/2003 |
| WO | 2008078912 | 7/2008 |

Grain Structure (1X)

Micro Structure (50X)

Production
Dendritic Porosity

GAPS

MX 25X
Dispersed Porosity

FIG. 14A Casting Parameters Profile

CASTING METHOD, APPARATUS AND PRODUCT

RELATED APPLICATION

This application is a continuation of U.S. patent application Ser. No. 13/998,273 filed Oct. 17, 2013, now U.S. Patent. No. 10,082,032, which claims benefits and priority of U.S. provisional application Ser. No. 61,796,265 filed Nov. 6, 2012, the entire disclosures of which are incorporated herein by reference.

FIELD OF THE INVENTION

The present invention relates to the casting of an article, such as a gas turbine engine blade or other turbine component having a highly variable cross-section and/or multiplex microstructure along its length, as well as to a cast article having an improved equiaxed microstructure along at least part of its length as a result of control of localized solidification.

BACKGROUND OF THE INVENTION

The production of sound equiaxed castings with significant grain uniformity by conventional investment casting processes requires considerable attention to the design of gating, runner, and riser systems as well as to the thermal parameters involved. This entails complex gating schemes to ensure proper metal delivery into the mold as well as a massive riser system to promote solidification toward the riser. Therefore, the gating efficiency of conventionally cast equiaxed castings is usually only in the range of 45 to 65%, whereby the lower metal efficiency results in higher manufacturing costs. The castings produced by conventional processes also suffer from high cost of welding and rework associated with difficulty in feeding molten alloy to form complex gas turbine castings having variable geometry. The gates and risers which are an integral part of casting geometry in the conventional process, also suffer from high cost of gate and riser removal and finishing costs to bring the part back to near net shape. The primary mode of heat transfer in conventional casting processes is mostly by passive conduction and radiation from the hot mold to its surroundings. As a result, the rate of heat extraction is limited.

SUMMARY OF THE INVENTION

The present invention provides a method and apparatus for casting a near-net shape metallic article, such as a gas turbine engine blade or other turbine component, under casting solidification conditions that embody controlled active gas cooling to form a progressively solidified, equiaxed grain microstructure along at least part of the length of the article.

An illustrative embodiment of the invention involves providing a melt comprising molten metallic material in a mold heated in a mold heating furnace to a temperature above a solidus temperature of the metallic material wherein the mold has an article-shaped mold cavity corresponding to that of the article to be cast, relatively moving the melt-containing mold and the furnace to withdraw the melt-containing mold from the furnace through one or more active cooling zones where cooling gas is directed against the exterior of the mold to actively extract heat in a manner to progressively solidify the melt there with an equiaxed grain microstructure along at least part of the length of the article.

A particular illustrative embodiment of the present invention envisions adjusting one or more of mold withdrawal rate from a furnace, cooling gas mass flow rate to the active cooling zone(s), and the mold temperature during mold withdrawal from the furnace depending upon particular article cross-section(s) reaching an active cooling zone [i.e. upon the mold reaching a withdrawal distance proximate the active cooling zone] in order to progressively solidify the melt along at least part of the length of the article mold cavity with an equiaxed grain microstructure. Another particular illustrative embodiment envisions solidifying a near-net shape gas turbine component with a microstructure that varies along its length by solidifying the melt in the mold cavity at the active cooling zone with a columnar grain or single crystal microstructure along at least part of the length of the component and adjusting at least one of the mold withdrawal rate, the cooling gas mass flow rate, and the mold temperature in dependence upon another part of the length of the component reaching the active cooling zone in order to progressively solidify the melt with an equiaxed grain microstructure along that part of the length of the component.

In another illustrative embodiment of the present invention, the method and apparatus embody introducing a molten metallic melt into a mold having an article-shaped mold cavity with a variable or uniform cross section along its length corresponding to that of the article to be cast. The mold temperature can be controlled in a mold heating furnace in a manner to remain above the solidus temperature or, alternately, above the liquidus temperature, of the metallic material until the mold is progressively and actively cooled along at least part of its length at one or more active cooling zones. The melt-containing mold and the furnace are relatively moved to withdraw the melt-containing mold from the furnace through at least one active cooling zone where cooling gas is directed against the exterior of the mold to progressively and actively extract heat as the mold is moved through the active cooling zone. Pursuant to the present invention, one or more of the mold withdrawal rate, the cooling gas mass flow rate at the active cooling zone(s), and the mold temperature is/are adjusted during mold withdrawal depending upon particular article cross-sections being proximate to an active cooling zone [i.e. upon the mold reaching a withdrawal distance proximate the active cooling zone] in order to progressively solidify the melt along at least part of the length of the article mold cavity with an equiaxed grain microstructure.

A particular illustrative embodiment of the present invention withdraws the melt-containing mold first through a primary active cooling zone and then through one or more additional (secondary) active cooling zones that supplements heat extraction from the mold. The active cooling zones each can include a plurality of nozzles disposed about a withdrawal path of the melt-containing mold from the furnace to direct cooling inert or other non-reactive gas jets at the mold.

In another illustrative embodiment of the present invention, the mold is provided with a relatively thin and thermally conductive mold wall defining the article mold cavity to facilitate heat extraction at the active cooling zone(s). The mold wall can be comprised of multiple layers with different thermal expansion coefficients to establish a compressive force on an innermost mold layer when the mold is hot. These molds contain an outer layer structure having lower thermal expansion than the inner layer structure to help to produce thinner walled ceramic molds, which are more thermally conductive.

In still another illustrative embodiment of the present invention, before mold withdrawal from the furnace, the temperature of the melt in the mold is controlled to be substantially uniform along the length of the mold cavity. Alternately, a non-uniform temperature profile of the melt along the mold length can be used in practice of the invention depending upon the particular article cross-section to be cast.

The present invention can be practiced to produce a cast or solidified article having an equiaxed grain region along all of its length. The present invention also can be practiced to produce a cast article having an equiaxed grain region along part of its length and another region of different grain structure, such as columnar grain, single crystal or different size equiaxed grain structure, along another or remaining length of the article. For example, practice of the present invention can provide a turbine component casting, such as a turbine blade or vane casting, having a variable cross-section along its length, wherein the casting exhibits a progressively solidified, equiaxed grain microstructure along all or a part of its length wherein the equiaxed grain microstructure typically is devoid of chill grains, columnar grains, and is substantially devoid (less than 1% porosity) of internal porosity. Moreover, the equiaxed grain microstructure typically exhibits substantially reduced microstructural phase segregation that permits the casting to undergo solution heat treatment cycle at a higher temperature without incurring incipient melting. The turbine blade or vane casting can be produced pursuant to another embodiment to have an equiaxed grain microstructure along the turbine blade root region and a different grain structure, such as columnar grain, single crystal or different size equiaxed grains, along the turbine blade airfoil region.

Further, practice of the present invention is especially useful in casting an equiaxed grain article, such as a turbine blade or vane, having an equiaxed grain microstructure along at least part of its length and a variable article cross-section that includes at least one cross-sectional region [e.g. turbine blade root region) that has at least two (2) times, typically at least four (4) times], the cross-sectional area of another cross-sectional region (e.g. turbine blade airfoil region) and where the cross-section of the article may vary continuously along its length. Practice of the present invention also can be useful in casting an equiaxed grain article having a substantially uniform or constant cross-section along its length.

The above advantages of the invention will become more readily apparent to those skilled in the art from the following detailed description taken with the following drawings.

BRIEF DESCRIPTION OF THE DRAWINGS

FIG. 9 illustrates at 1× the equiaxed grain microstructure produced pursuant to the present invention, while

FIG. 14A is a graph illustrating varying of the mold withdrawal rate and cooling gas mass flow rate with near constant mold temperature in order to control solidification to produce the equiaxed grain structure for the gas turbine bucket of FIG. 14.

DETAILED DESCRIPTION OF THE INVENTION

The present invention is especially useful, although not limited to, manufacture of equiaxed grain metallic articles, such as turbine blades, vanes, buckets, nozzles, and other components, where the article has a cross-section (taken perpendicular to the longitudinal axis of the article) that varies significantly along the length of the article, although the invention can be used in the manufacture of articles with a substantially uniform or constant cross section along its length as well. The cross-sectional variation of the article to be cast can result in a large variation in mass along the article length and/or also may be due to a geometry variation that results merely in a large dimensional change with little mass change (e.g. an enlarged turbine blade overhang or platform with little mass change) along the article length. The present invention also is useful, although not limited to, manufacture of multiplex microstructure metallic articles, such as turbine blades, vanes, buckets, nozzles, and other components, where the article has an equiaxed grain microstructure along part of its length and another microstructure, such as a columnar grain or single crystal microstructure, along another part of its length. In practice of the invention, in addition to passive conduction and radiation cooling, an active convection cooling is applied to extract substantially larger amount of heat from the hot mold and casting to maintain a substantially constant solidification rate despite varying heat content due to varying molten metal cross-sections and mold cross-sections.

Figure 1:
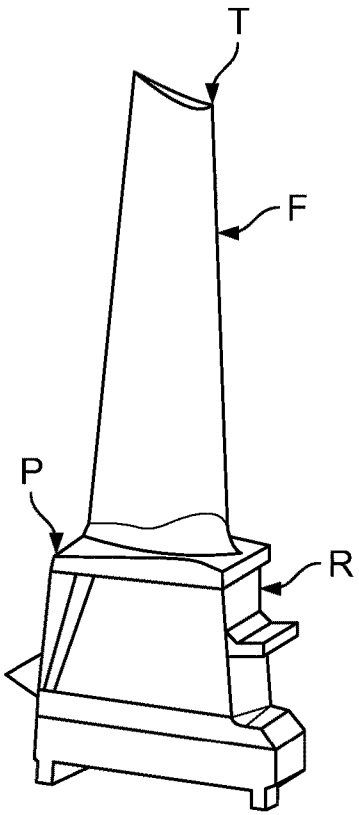
FIG. 1 is a perspective view of an exemplary gas turbine engine blade illustrating a blade cross-section that varies considerably from a root end to a tip end of the blade.

For purposes of illustration of a particular embodiment and not limitation, the present invention is useful for making an equiaxed grain casting that includes at least one cross-sectional region having a substantially larger [e.g. at least two (2) times] cross-sectional area than another cross-sectional region and where the cross-section of the article may vary continuously along its length. An exemplary equiaxed grain casting of this type comprises an industrial or aero gas turbine engine blade, FIG. 1, having an enlarged root region R, an enlarged platform region P, an airfoil region F, and a blade tip T, which may be enlarged or not relative to the airfoil cross-section. Other gas turbine components, such as vanes, buckets, compressor segments, nozzles, and other components also having a highly variable or substantially uniform cross-section can be manufactured pursuant to the present invention. Such gas turbine blades, vanes, buckets, nozzles, and other components are typically made of well known nickel base, cobalt base, or iron base superalloys such as GTD 111, IN 738, MarM 247, U500, and Rene 108, although the present invention can be practiced to cast a variety of metals and alloys (hereafter metallic materials). For example, Co-based nozzle alloys and stainless steel hardware alloys can be cast as well.

For purposes of illustration and not limitation, the present invention will be described in connection with the casting of an equiaxed grain, near-net-shape superalloy gas turbine engine blade where near-net-shape refers to a casting that has as-cast contoured surfaces to improve air flow and heat transfer where no post-cast machining is allowed. The equiaxed grain, near-net-shape cast blade is made under controlled casting conditions including controlled active cooling to form a progressively solidified, equiaxed grain microstructure along all or part of the length of the blade. The cast equiaxed grain microstructure preferably is substantially devoid of chill grains (very fine grains at the casting surface), columnar grains (elongated grains), and internal porosity along the length of the cast blade, although an alternative embodiment of the invention envisions the localized presence of columnar grains in a region outside of the cast blade design, which columnar grained end region can be removed (cut off) of the blade to bring it to part specifications. Moreover, another alternative embodiment of the invention envisions a dual microstructure turbine engine component (e.g. blade or vane) where the equiaxed grain microstructure produced by practice of the invention is present along a part of its length while another microstructure, such as columnar grain, single crystal, or different size equiaxed grain, is intentionally provided along another or remaining part of its length. For example, the turbine blade casting can be solidified to have an equiaxed grain microstructure along its root region and a columnar grain, single crystal, or different size equiaxed grain microstructure along its airfoil region.

The method and apparatus involve casting of a near-net shape metallic article, such as a gas turbine engine component (e.g. blade, vane, bucket, nozzle, etc.) under casting conditions that embody controlled active cooling to form a progressively solidified, equiaxed grain microstructure along at least part of the length of the article. The controlled active cooling parameters are implemented in response to the collective heat load of the mold to be cast, which includes the metal or alloy composition, metal or alloy amount, and temperature of the molten metallic material and the mold temperature and mold mass.

In order to cast an equiaxed grain, near-net-shape gas turbine engine blade, the present invention provides a casting mold having an article-shaped mold cavity whose cross-section varies along its length corresponding to that of the blade to be cast. For manufacture of a gas turbine blade, the mold typically comprises an investment shell mold made by investing a fugitive pattern assembly, such as a wax pattern assembly, in multiple layers of ceramic slurry and ceramic particulates, all as is well known. After the shell mold is formed on the pattern assembly, the pattern assembly is selectively removed by steam autoclaving and/or other heating technique to melt the pattern material, chemical dissolution, or other well known technique to leave an unfired ceramic shell mold having the mold cavity with the desired near-net-shape of the blade to be cast. The shell mold then is fired to develop adequate mold strength for casting. The pattern removal process can precede as a separate step or be part of the thermal treatment (firing) of the mold.

Figure 2:
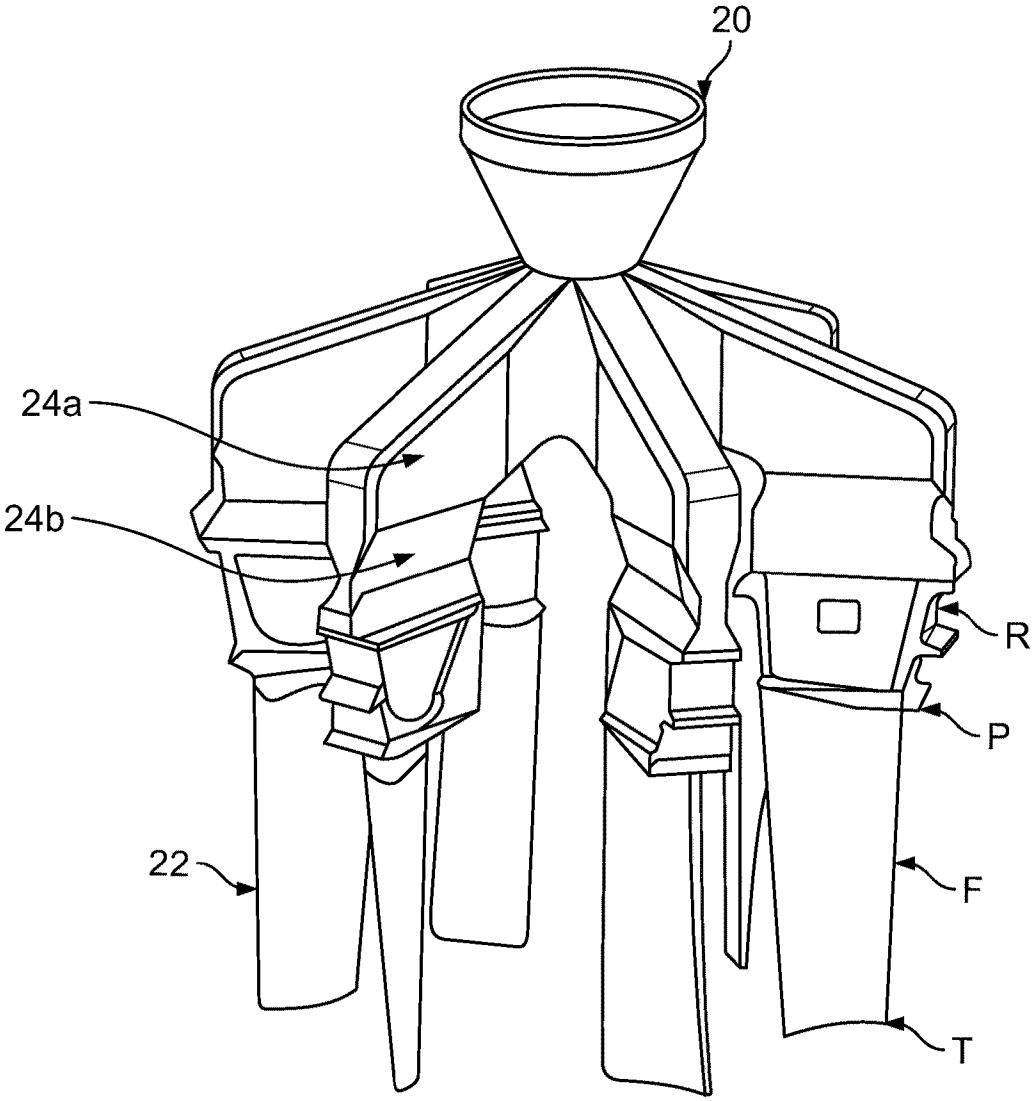
FIG. 2 is a perspective view of a wax pattern assembly comprised of six individual wax turbine blade patterns connected to a wax pour cup by respective wax gating.

For purposes of illustration and not limitation, FIG. 2 illustrates a wax pattern assembly for casting six (6) turbine blades. The wax pattern assembly includes a pour cup pattern 20, turbine blade patterns 22, and gating patterns 24*a*, 24*b* (shown as narrow rib-shaped regions) connecting each blade pattern to the pour cup pattern. The turbine blade patterns replicate the shape of the turbine blades to be cast and include a root region R, platform region P, airfoil region F, and tip region T wherein the cross-section of the each pattern 22 varies significantly along its length as a result. The turbine blade patterns 22 are shown connected to the pour cup in a root-up and tip-down orientation in FIG. 2, but they can be connected in a root-down and tip-up orientation as well although this is not preferred for the turbine blade patterns shown in FIG. 2 which have much enlarged root regions compared to the tip regions. The pattern assembly is repeatedly dipped in ceramic slurry, drained of excess slurry, and stuccoed with ceramic particulates applied on the ceramic slurry to build up a shell mold assembly M on the pattern assembly, FIG. 3, where the shell mold is represented by the dashed line around the pattern assembly. The pattern assembly is selectively removed from the shell mold assembly by steam autoclaving or other heating technique, and then the shell mold assembly is fired to develop adequate mold strength for casting. The shell mold assembly will include six mold cavities MC having a shape corresponding to that of the turbine blade patterns 22 with each blade mold cavity connected to a pour cup by a respective gating passage formed by removal of the gating patterns 24*a*, 24*b* as is well known.

The present invention can be practiced using conventional ceramic investment molds made in the manner described above. Alternately, the investment shell mold is made in a manner to have a relatively thin and/or thermally conductive mold wall defining the turbine blade-shaped mold cavity to facilitate heat extraction at the active cooling zone(s). An investment shell mold for use in practice of the invention can be comprised of multiple invested layers with different thermal expansion coefficients to establish a compressive force on an innermost mold layer when the mold is hot such as used in single crystal and directional solidification processes. For example, FIG. 3A schematically shows an investment shell mold wall that is thin and thermally conductive by virtue of including two to three less slurry and stucco layers than conventional investment shell molds wherein the inner mold layer structure is made of a low thermal conductivity and high thermal expansion ceramic material and the outer layer structure is made of high thermal conductivity and low thermal expansion ceramic material. An investment shell mold that has 30% or more higher radiation cooling properties than conventional mold is useful in practice of the invention. The investment shell mold also can comprise an intermediate and/or outer mold layer embodying a fiber reinforcing wrap such as disclosed in U.S. Pat. No. 4,998,581 for alumina or mullite fiber reinforcing wrap and U.S. Pat. No. 6,364,000 for a carbon based (e.g. graphite) fiber reinforcing wrap to provide a compressive force on the innermost mold layer. The mold also may contain filaments or other discontinuous reinforcement fibers in the intermediate layers to increase green and fired tensile strength of the mold such as in U.S. Pat. No. 6,648,060.

Figure 3:
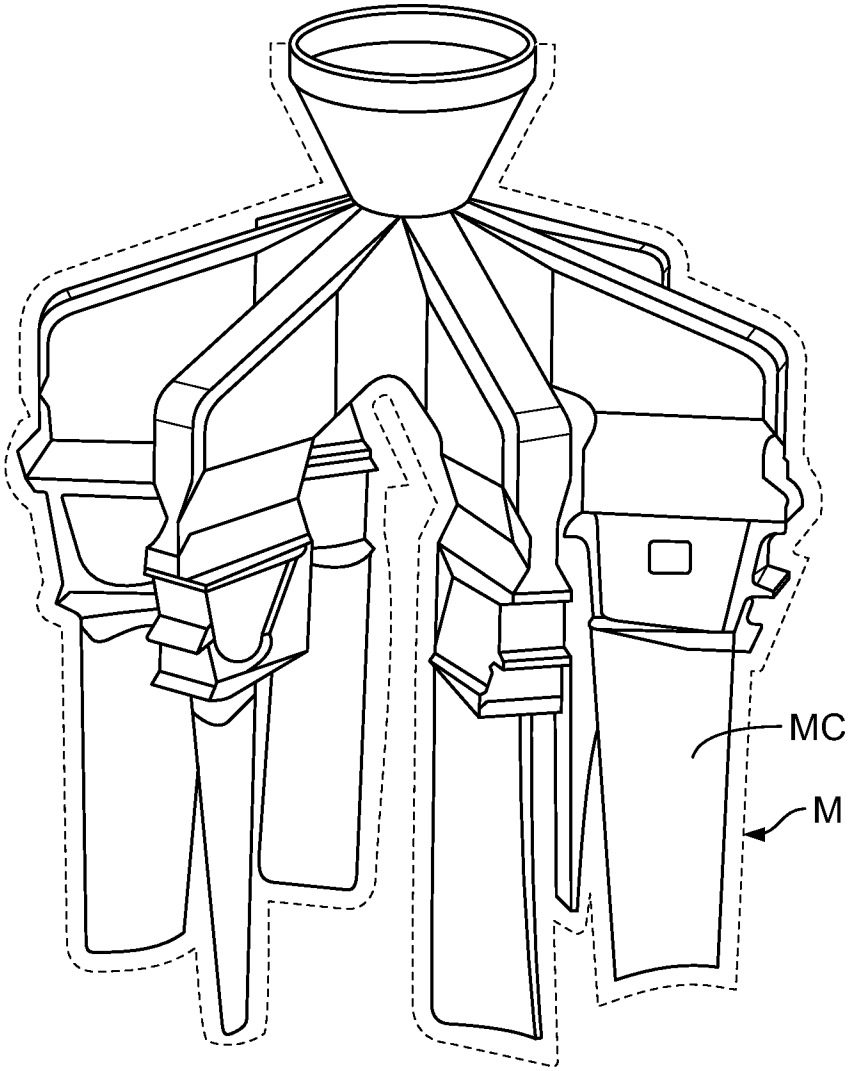
FIG. 3 is a perspective view of the wax pattern assembly invested in a ceramic shell mold represented by dashed lines around the pattern assembly.
Figure 3B:
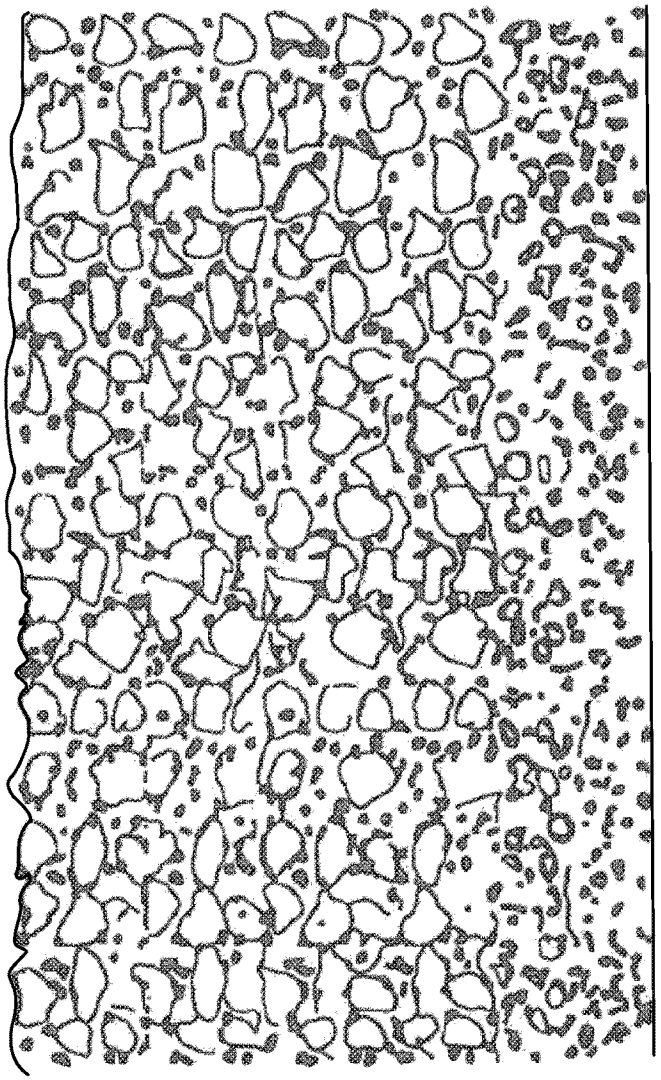
FIG. 3B (Prior Art)
FIG. 3B is a sectional view of a conventional multi-layer wall of an investment mold having greater mold wall thickness.
Figure 4:
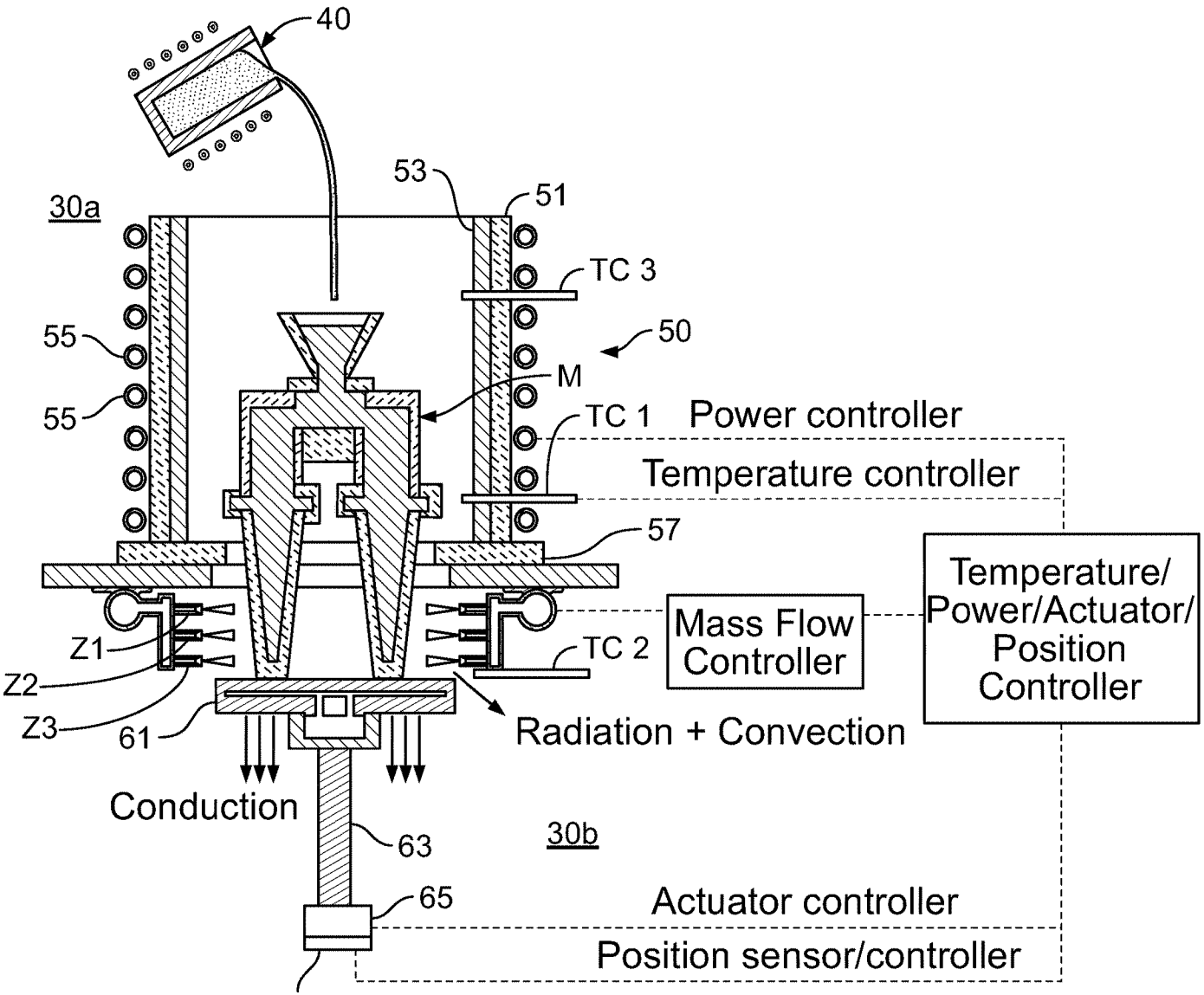
FIG. 4 is a schematic view of equiaxed casting apparatus pursuant to an illustrative embodiment of the invention with multiple (e.g. three) active cooling gas zones supplied with cooling gas from a common cooling gas supply manifold.

FIG. 4 schematically illustrates an equiaxed casting apparatus having active cooling gas zones Z1, Z2, Z3 pursuant to an illustrative embodiment of the invention for casting one or more gas turbine blade(s) in the shell mold assembly M of the type described above and shown in FIG. 3. The casting apparatus includes an upper vacuum casting chamber 30*a* in which an induction melting crucible 40 and a mold heating furnace 50 are disposed and a lower vacuum cooling chamber 30*b* shown for purposes of illustration as having multiple active cooling zones Z1, Z2, Z3 immediately below the bottom of the mold heating furnace 50, although the invention using one or more active cooling zones. The induction melting crucible 40 is provided to vacuum melt a solid charge of the superalloy to be cast and also heat the melt in the crucible to a desired superheat temperature for casting. The crucible 40 can pivot to pour the melt into the underlying mold assembly in the mold heating furnace or can include a lower valved discharge opening to this same end as is well known.

Figure 3A:
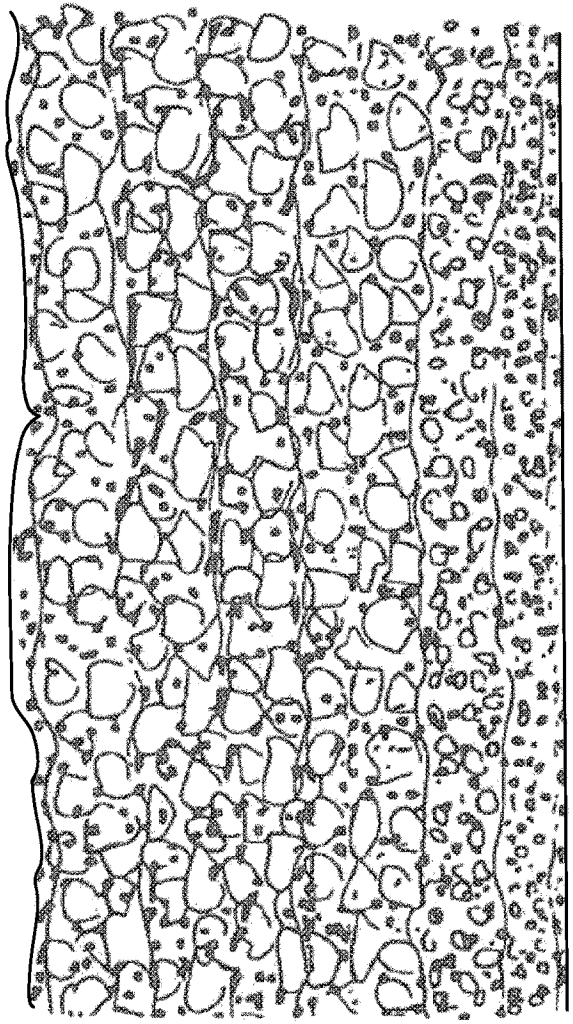
FIG. 3A is a sectional view of an exemplary, multi-layer wall of an investment mold for use in practice of the present invention.

In FIG. 4, the shell mold assembly M is shown to be similar to that shown in FIG. 3 after removal of the wax patterns and after firing to develop mold strength for casting to cast multiple turbine blades at a time. The shell mold assembly to be cast is placed on a water-cooled chill plate 61 on a ram 63 that is movable up and down by a hydraulic, electrical or other actuator 65. The shell mold assembly is moved relative to radiation shield or baffle 57 that defines an upper relatively hot zone and lower relatively cold zone as is well known. In FIG. 4, the shell mold assembly M is shown schematically with the closed bottom mold ends of the blade mold cavities resting on the chill plate 61. Alternately, the closed bottom ends of the shell mold assembly can rest on a thermal insulation member (not shown) on the chill plate 61 to reduce or eliminate heat conduction to the chill plate.

Figure 5:
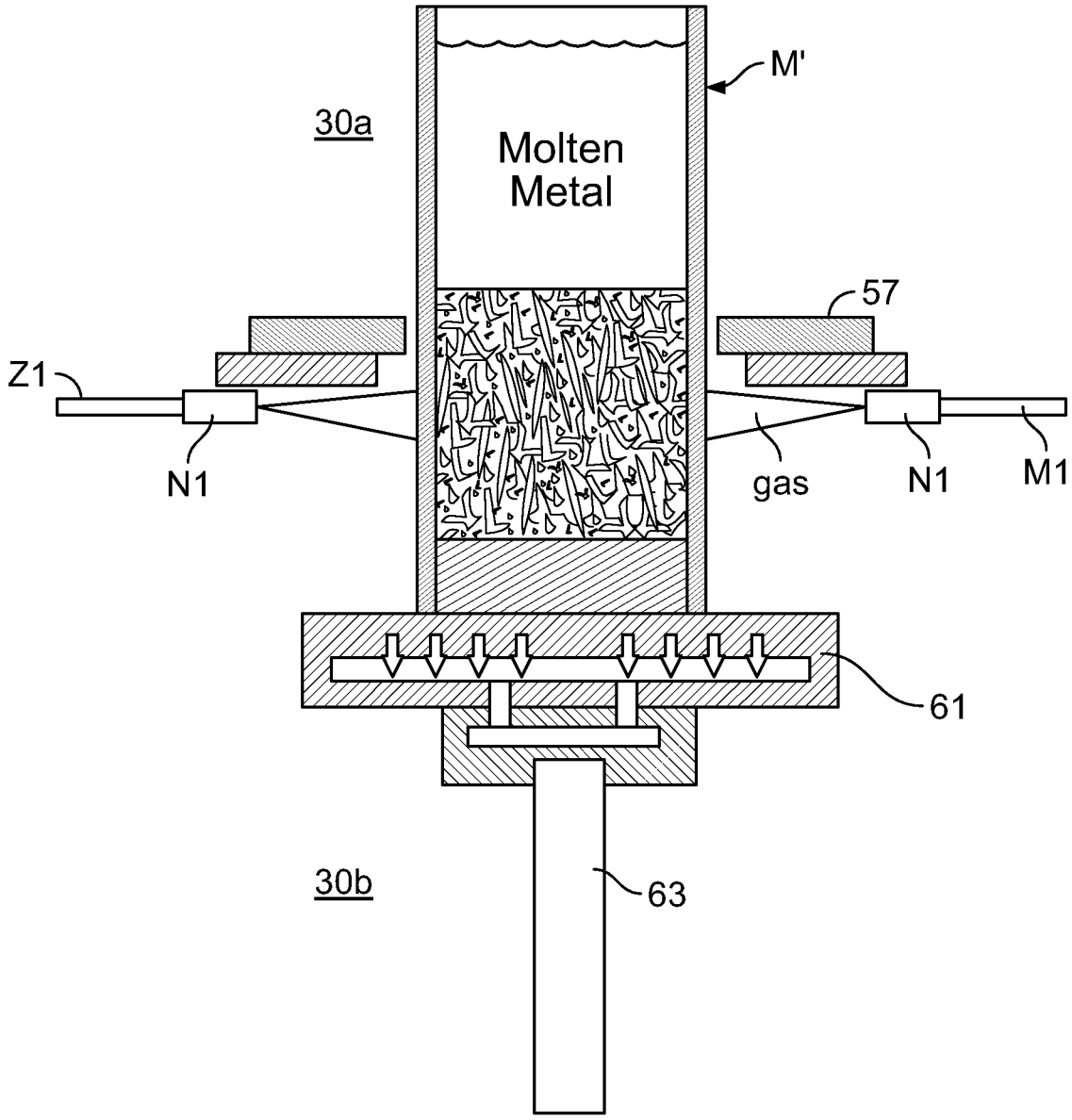
FIG. 5 is a schematic view of equiaxed casting apparatus pursuant to another illustrative embodiment of the invention with a single active cooling zone that is supplied with cooling gas from a cooling gas supply manifold.

FIG. 5 illustrates another embodiment for practice of the invention where a schematically shown uniform cross-section single mold M' has an open bottom end resting directly on the chill plate 61 such that elongated columnar grains may be formed at the lower end of the cast article adjacent to the chill plate 61 as the mold is moved past the baffle 57 of the mold heating furnace (not shown but similar to that of FIG. 4 in the upper vacuum casting chamber 30*a*) through the single active cooling zone Z1 in the lower vacuum cooling chamber 30*b*. The mold bottom end alternatively can be closed as by a thin ceramic bottom wall of a ceramic shell mold such as illustrated in FIG. 4. This embodiment may require removal (by cutting off or other machining) of the columnar grains present at the lower end of the cast blade and also design of the mold cavity shape to accommodate this sacrificial portion of the cast article. Alternatively, the article can be intentionally cast in mold M' with a columnar grain microstructure (or single crystal) at a lower region as shown and an equiaxed grain microstructure upper region pursuant to an embodiment of the invention to provide a dual microstructure component as described below. A single crystal lower region can be provided by positioning a crystal selector and/or starter (e.g. pigtail crystal selector and/or starter seed) adjacent to the lower end of the mold as is well known.

The mold temperature can be controlled by the mold heating furnace 50, FIG. 4, in a manner as to remain above the solidus temperature of the superalloy (melt temperature is substantially equal to the mold temperature) along the mold length until the mold assembly is actively cooled along its length at active cooling zones Z1, Z2, Z3. Alternately, the mold temperature can be controlled by the mold heating furnace 50 in a manner as to remain above the liquidus temperature of the superalloy along the mold length until the mold assembly is actively cooled along its length at active cooling zones Z1, Z2, Z3. The choice of a particular mold temperature will be determined in conjunction with mold withdrawal rate and cooling gas mass flow rate of one or more active cooling gas zones as described below to form a progressively solidified, equiaxed grain microstructure along at least part of the length of the cast turbine blade.

The mold heating furnace 50 includes an upstanding wall comprised of an annular thermal insulation sleeve 51 around an annular graphite susceptor 53 with induction coils 55 disposed around the thermal insulation sleeve for induction heating of the susceptor 53, which in turn heats the melt-containing mold assembly M to control mold temperature and thus melt temperature. The temperature of the melt in the mold assembly M can be controlled to be substantially uniform along the length of the mold cavity in one embodiment. Alternately a non-uniform temperature profile of the melt along the mold length can be provided depending upon the particular article cross-section to be cast as to achieve the desired microstructure along the length of the article to be cast.

The mold heating furnace 50 includes the radiation shield or baffle 57 at the open bottom end through which the shell mold assembly M is withdrawn from the furnace 50 into the lower cooling chamber 30*b*.

After the melt is introduced into the preheated shell mold assembly, the melt-containing mold assembly and the mold heating furnace 50 are relatively moved to withdraw the melt-containing mold assembly M (or M' of FIG. 5) from the furnace 50 through the opening in the baffle 57 and then immediately through the multiple active cooling zones Z1, Z2, Z3 (or single cooling zone Z1 in FIG. 5) where cooling gas is directed against the exterior of the mold to actively extract heat. Referring to FIG. 4, the melt-containing mold assembly M typically is withdrawn from the furnace 50 by lowering of the ram 63 using actuator 65 at predetermined and/or feedback controlled mold withdrawal rate. Alternately, the furnace 50 can be moved relative to the mold assembly M, or both the furnace and the mold assembly can be relatively moved to withdraw the melt-containing mold from the furnace 50.

Referring to FIG. 4, multiple active cooling gas zones Z1, Z2, Z3 are shown in fixed position immediately below the furnace baffle 57 so that the melt-containing mold assembly is moved successively through the active cooling gas zones by lowering of the ram 63, although the active cooling zones may be mounted so as to be movable along the path when the furnace is movable. Any number of active cooling zones can be used in practice of the invention. For purposes of illustration and not limitation, when active cooling zones Z1 and Z2 are employed, the first cooling gas zone Z1 can be positioned one inch or other appropriate distance below the baffle 57, while the second cooling gas zone can be positioned three inches or other appropriate distance below the baffle 57.

Figure 7B:
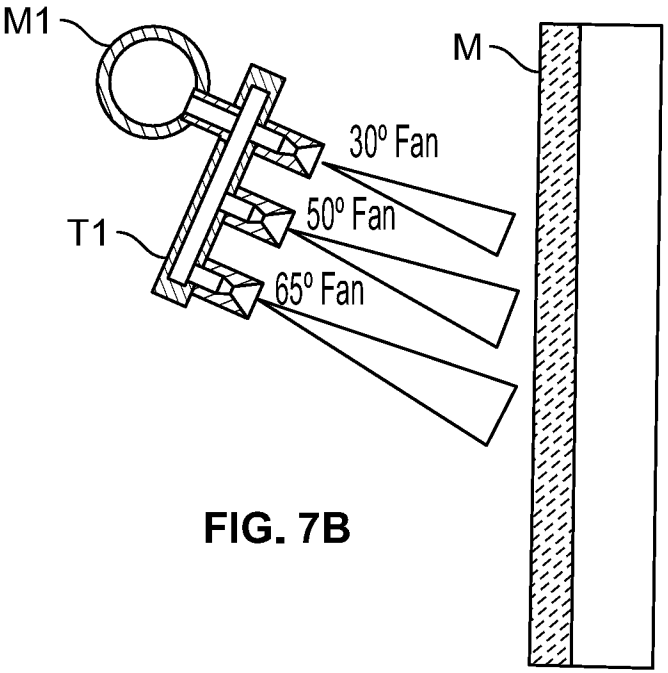
FIG. 7B is a schematic partial sectional view of a cooling gas manifold having fan type cooling gas discharge nozzles mounted thereon with different gas discharge patterns (e.g. 30°, 50°, and 65°).
Figure 7A:
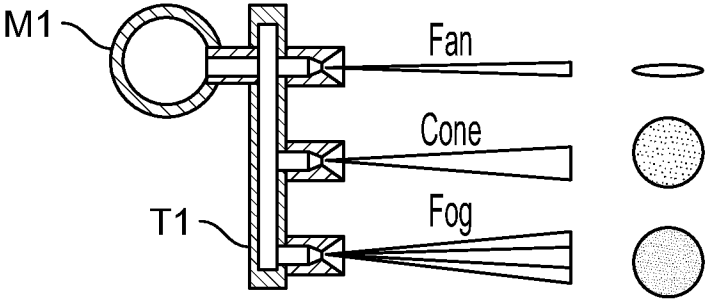
FIG. 7A is a schematic partial sectional view of a cooling gas manifold having different types (e.g. fan, cone, fog) of cooling gas discharge nozzles mounted thereon.

For purposes of illustration and not limitation, the first, second, and third active cooling gas zones Z1, Z2, and Z3 are associated with a common cooling gas supply ring manifold M1 located about the path of mold withdrawal from the furnace so that the melt-containing mold assembly passes through the manifold as it is lowered on the ram 63. A plurality of cooling gas discharge nozzles N1, N2, N3 are mounted on respective secondary vertical tubular gas manifolds T1, which are communicated to the main manifold M1. Nozzles N1, N2, N3 on manifolds T1 are spaced apart about the circumference of the manifold M1 and discharge cooling gas under pressure and at a predetermined and/or feedback controlled cooling gas mass flow rate toward and against the exterior surface of the mold assembly as it passes through cooling zones Z1, Z2, Z3. The invention envisions use of multiple separate ring manifolds in lieu of single ring manifold M1 each manifold having respective cooling gas discharge nozzles N1, N2, N3 mounted directly thereon or on secondary gas manifolds mounted thereon. The gas discharge nozzles can be fan, fog, cone or hollow cone type nozzles or any other suitable type to direct focused or confined gas jets at the mold. For example, FIG. 7A illustrates fan nozzles at cooling zone Z1, cone nozzles at cooling zone Z2, and fog nozzles at cooling zone Z3 for purposes of illustration only and not limitation. The invention envisions that gas discharge nozzles can be spaced equally or un-equally around the ring manifold M1 to achieve a desired active cooling effect for a given mold shape being withdrawn. Similarly, gas discharge nozzles of different types and in different arrays can be present on each manifold to achieve a desired cooling effect for a given mold shape being withdrawn.

Practice of the invention can be effected using nozzle N1, N2, N3 of the conventional fog, fan, cone, or hollow cone type that are initially adjustable to adjust the direction and angle of cooling gas discharge pattern and then tightened to fix that adjusted nozzle position. The plurality of gas discharge nozzles defining a periphery of the active cooling zone provide gas streams which are primarily turbulent gas flow in the first cooling zone and lamellar gas flow in the second cooling zone, or vice versa, wherein additional numbers of active cooling zones of different types can be provided to achieve the desired active cooling effect and microstructure along the length of the cast article. The two typical illustrative arrangements of nozzle arrays are based primarily on impingement cooling or film cooling. The gas discharge nozzles can be equally or un-equally spaced apart or arranged in other arrays on the manifolds depending upon the shape of the melt-containing mold being withdrawn.

The invention envisions using cooling gas discharge nozzles N1, N2, N3 that can be aligned and fixed in desired position/orientation on the manifold M1 or, alternately, can be movable or pivotable thereon by individual motors, actuators, or other nozzle moving mechanisms (not shown) to vary their vertical and horizontal orientations relative to the mold assembly M as it is being withdrawn.

Figure 7C:
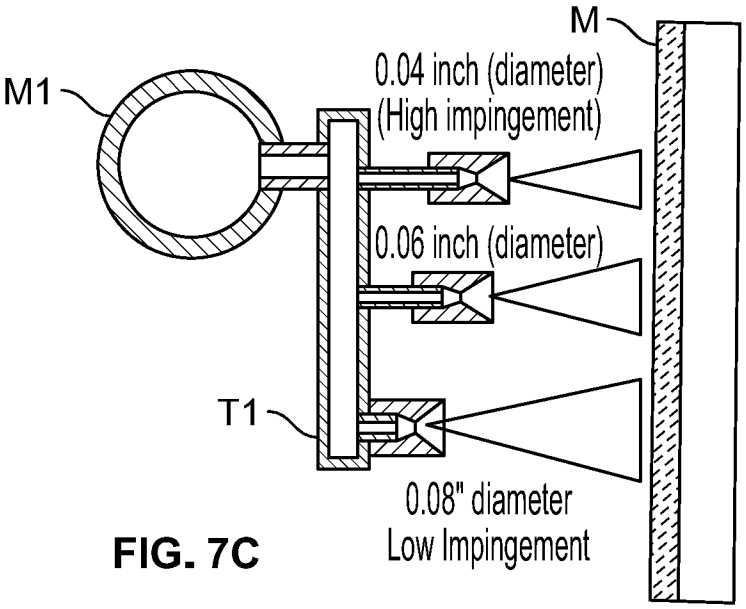
FIG. 7C is a schematic partial sectional view of a cooling gas manifold having gas discharge nozzles mounted thereon with different types of impingement action on the mold wall, such as high, intermediate, and low impingement, depending on nozzle-to-mold wall distance and orifice diameter.

The effectiveness of gas cooling is impacted by the distance and inclination (vertical orientation) of the nozzles relative to the mold M, by the number and type of nozzles used to cool a particular mold shape, and by the cooling gas pressure with higher cooling gas pressure providing higher mass flow rate and gas impingement velocity on the mold. Heat extraction can be optimized through control of either gas pressure or gas volume flow, or both to this end. For example, FIG. 7B illustrates 30° fan nozzles N1 at cooling zone Z1, 50° fan nozzles N2 at cooling zone Z2, and 65° fan nozzles N3 at cooling zone Z3 for purposes of illustration. FIG. 7C illustrates different types of impingement velocity action on the mold wall as a way to optimize heat extraction from the melt-containing mold by optimizing the distance and diameter (and also type) of the gas discharge nozzles employed in the cooling zones; namely, a high gas velocity impingement effect, intermediate gas velocity impingement effect, and low gas velocity impingement effect, by varying the nozzle-to-mold wall distance and the nozzle orifice diameter as shown. The sequencing of the nozzles and their inclinations in the cooling zone(s) typically is part-specific (based on a particular casting geometry) to vary the impingement or film cooling needed. For example, when impingement cooling is desired, the cooling gas pressure and volume may both be high. In film cooling, the pressure may be low but compensated for by increased cooling gas volume to maintain the same cooling gas mass flow.

For purposes of further illustration and not limitation, FIG. 4 schematically illustrates exemplary orientations of the cooling gas discharge nozzles N1, N2, N3 at respective active cooling zones Z1, Z2, Z3 relative to the shell mold assembly M being withdrawn.

Figure 8:
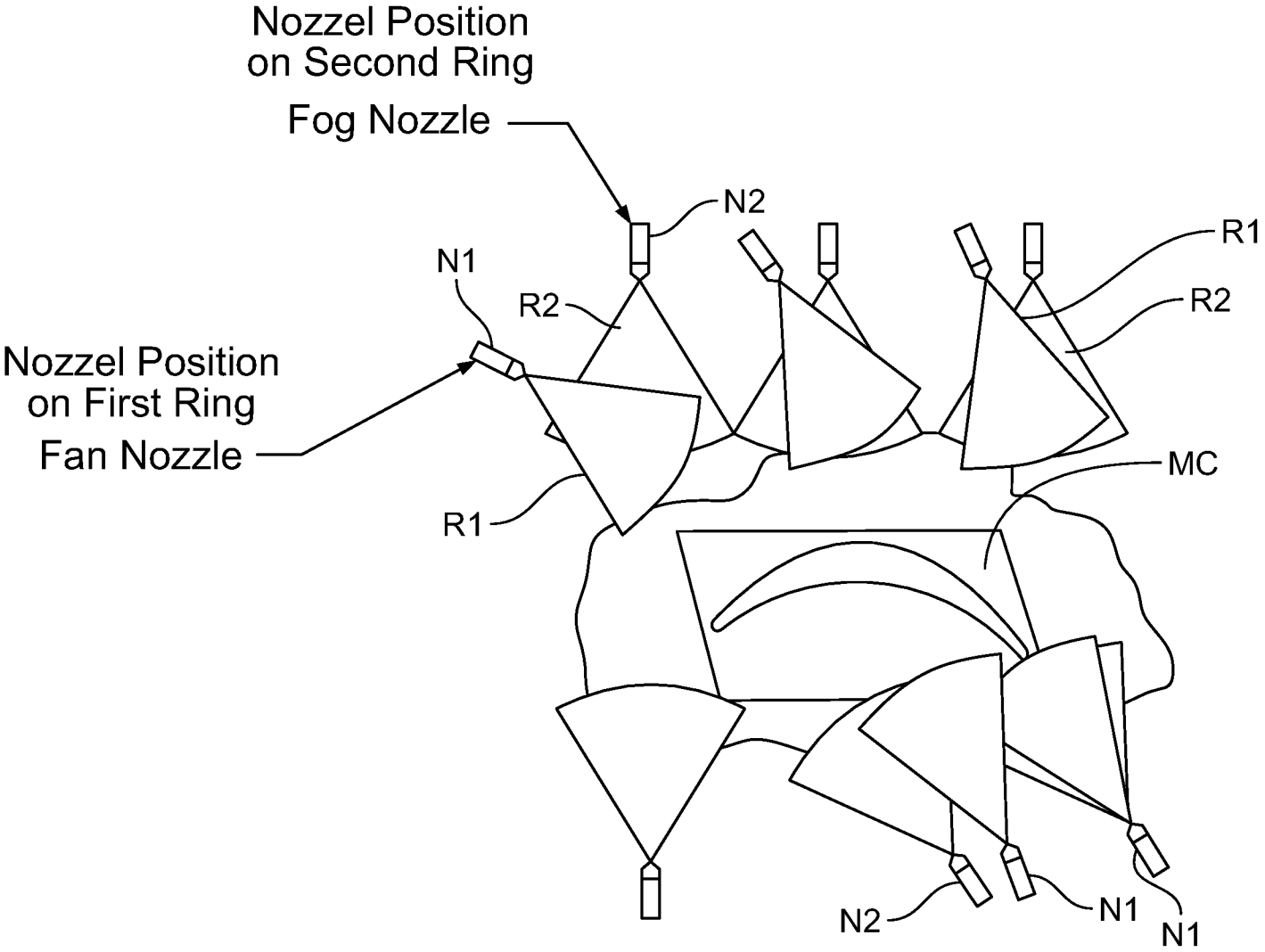
FIG. 8 illustrates an exemplary horizontal orientation of the cooling gas discharge nozzles relative to the shell mold being withdrawn pursuant to another embodiment of the invention.

For purposes of still further illustration and not limitation, FIG. 8 shows an exemplary horizontal orientation of the fan type cooling gas discharge nozzles N1 at a first cooling zone Z1 and fog type cooling gas discharge nozzles N2 at a second lower active cooling zone Z2 relative to a shell mold cavity MC being withdrawn to optimize cooling pursuant to another embodiment of the invention. In FIG. 8, the fan and fog cooling gas discharge nozzles N1 and N2 (or other nozzles such as cone or hollow nozzles) are shown in a non-circular pattern or array around the mold cavity MC being withdrawn to this end for purposes of illustrating this embodiment. The cooling gas patterns are shown by the wedge-shaped regions R1, R2 of the respective nozzles N1, N2. The cooling gas ring manifold on which the cooling gas discharge nozzles reside can be configured in non-circular shape to this end as well depending upon the particular mold shape being gas cooled and can include a respective mounting fixture (metal plate) on which the nozzle arrays can be mounted on the ring manifold for ease of assembly and nozzle adjustment relative to the mold.

The horizontal and vertical orientations of the gas discharge nozzles in the cooling zone(s) are chosen to provide maximum heat extraction (by impingement or film cooling) from the melt-containing mold.

The active cooling zone(s) Z2, Z3, etc. supplement(s) the heat extraction capability of the active cooling zone Z1. The distance between the cooling zones Z1, Z2, Z3, etc. as well as other additional cooling zones can be varied based on vertical angles of nozzles and number of nozzles used. Any number of multiple active cooling zones can be used in practice of the invention.

Figure 6:
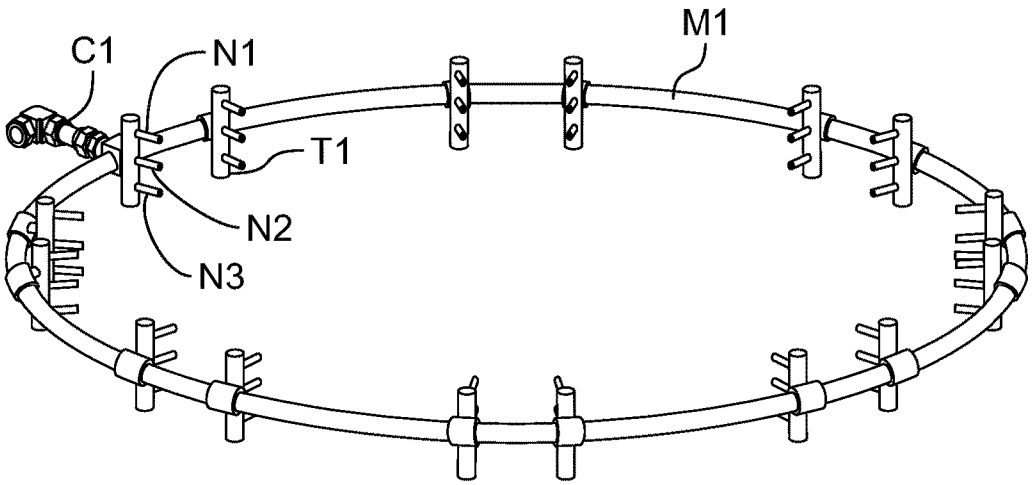
FIG. 6 is a perspective view of an exemplary active cooling zone comprising a cooling gas ring manifold having a plurality of cooling gas discharge nozzles spaced about the ring manifold.
Figure 6A:
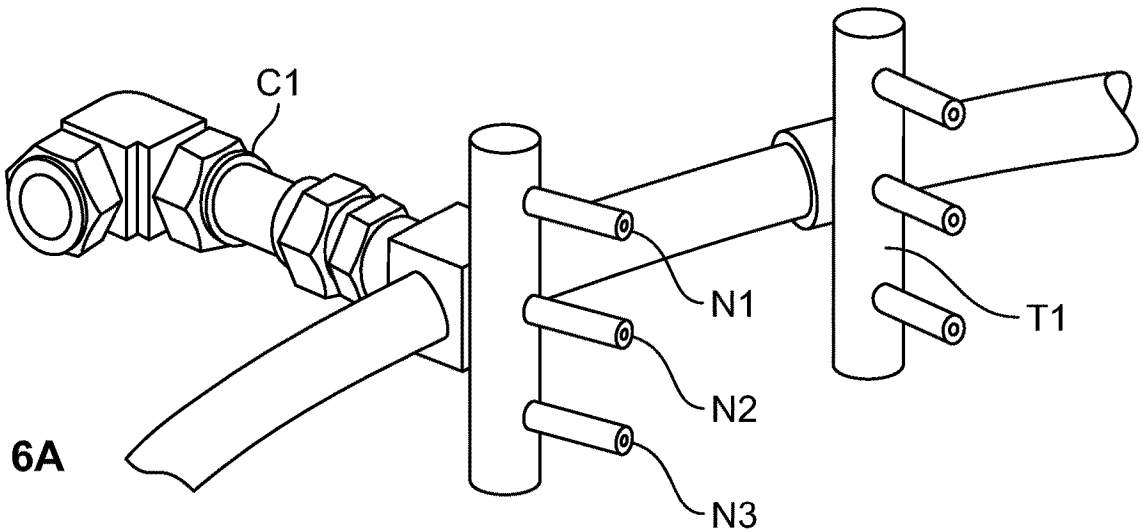
FIG. 6A is a partial, enlarged perspective view of FIG. 6.

The cooling gas ring manifold M1 is supplied with a cooling gas that is non-reactive with the melt from gas supply lines or conduit C1, FIG. 6, and typically comprises an inert gas, such as argon, helium and mixtures thereof, or other suitable gas, at or near room temperature or other suitable cooling gas temperature. The types and ratios of individual make-up gases comprising the cooling gas can be selected as desired to achieve a desired active cooling effect depending upon the types, numbers, orientations of the gas discharges nozzles employed. The cooling gas is supplied to the manifold M1 via line or conduit C1 connected to a mass flow controller as shown in FIG. 4 and as described below in more detail.

As the melt-containing mold assembly is withdrawn from the furnace 50 and approaches the active cooling gas zones Z1 and Z2 as determined by sensing the mold withdrawal distance out of the furnace, the present invention provides for the predetermined or feedback adjustment of at least one of the mold withdrawal rate, the cooling gas mass flow rates from the nozzles N1, N2, N3, and the mold temperature in dependence upon a particular blade mold cavity cross-section reaching the active cooling zone (i.e. upon the mold reaching a withdrawal distance that is proximate to the active cooling zone(s)] in order to progressively solidify the melt in the article mold cavity with an equiaxed grain microstructure along the length of the mold cavity. Adjustment of at least one of the variable mold withdrawal rate, the variable cooling gas mass flow rate, and variable mold temperature during mold withdrawal can be predetermined by a process computer program stored in a computer control device Temperature Power/Actuator Controller based on mold withdrawal distance out of the mold heating furnace 50 or can be controlled pursuant to feedback from one or more thermocouples TC1, TC2, TC3 positioned along the path of mold withdrawal and one, more, or all of which thermocouples providing mold and/or melt temperature signals to a computer control device (TC1 shown providing signals in FIG. 4 simply for convenience). The Temperature Power/Actuator Controller, FIG. 4, is interfaced to the mold movement ram actuator 65, to the mass flow controller to the cooling gas manifold M1, and to the induction coils 55 to vary the casting parameters to achieve the desired microstructure along at least part of the length of the article being cast. The cooling gas mass flow rate can be varied by a mass flow controller that supplies cooling gas to the manifold M1 and/or by varying the number of cooling gas discharge nozzles operated to discharge cooling gas as a particular mold section passes through the cooling zones. The mass flow controller can be a commercially available mass flow controller.

The adjustment can be made based on empirical experiments that determine the proper withdrawal rate and/or cooling gas flow rate at a given mold heat load to achieve the desired progressively solidified, equiaxed microstructure along at least part of the length of the cast blade, or based on computer simulation models of solidification of the melt in the mold cavity under different conditions of mold temperature, withdrawal rate, and cooling gas mass flow rate for a given mold heat load, or based on a thermocouple feedback loop as discussed above. The information to achieve the predetermined adjustment can be embodied in a control algorithm stored in suitable computer control device Temperature Power/Actuator Power Controller that controls the ram actuator 65, the mass flow controller, and the induction coils 55 to achieve the progressively solidified, equiaxed grain microstructure along at least part of the length of the cast blade. Moreover, the invention envisions optionally also controlling the mold temperature and thus the melt temperature in dependence on a particular article cross-section reaching the active cooling zone(s) where a lower temperature may be called for a larger cross-section region of the blade approaching the active cooling zones to reduce the total heat content, or vice versa. Approach of the mold to the active cooling zone can be detected by sensing the mold withdrawal distance out of the mold heating furnace 50 using a ram position sensor 65*a* associated with or part of the actuator 65 for purposes of illustration. The computer control device also can control the induction coils 55 to this end pursuant to a programmed and/or thermocouple feedback schedule.

The present invention can be practiced using one, two or all of the active cooling zones Z1, Z2, Z3 depending on the conditions of casting. However, use of the active cooling zones Z1, Z2 as well as other optional additional cooling zones is preferred so that the latter cooling zones Z2, etc. can continue to extract heat from the mold and thus the melt to prevent any harmful rise in temperature of already solidified melt from the effects of molten metal thereabove during mold withdrawal.

Practice of the present invention as described above produces a cast turbine blade that has a progressively solidified, equiaxed grain structure along at least part of its length and that is substantially devoid of chill grains (very fine surface grains) and columnar grains. Preferably, the cast turbine blade also is substantially devoid of internal porosity along its length. A cast blade, which comprises a nickel or cobalt base superalloy, can have a progressively solidified, equiaxed grain size with an ASTM grain size in the range of 1 to 3.

Achievement of the progressively solidified, equiaxed grain microstructure along the length of the turbine blade is further advantageous to substantially reduce microstructural phase segregation that in turn permits the cast blade to be subsequently solution heat treated at higher temperature without incurring incipient melting. The higher solution heat treatment temperature promotes precipitation of a large quantity of fine gamma prime precipitates in a nickel base superalloy during quenching from heat treat and subsequent aging, and these fine precipitates impart required mechanical properties to the superalloy.

Figure 9:
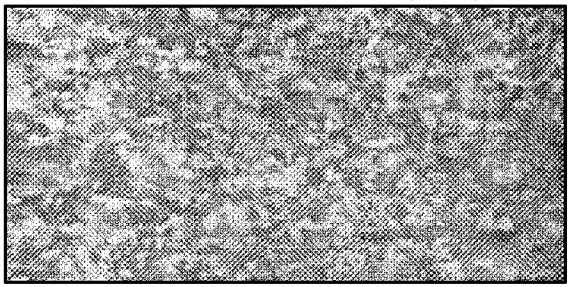
Figure 10:
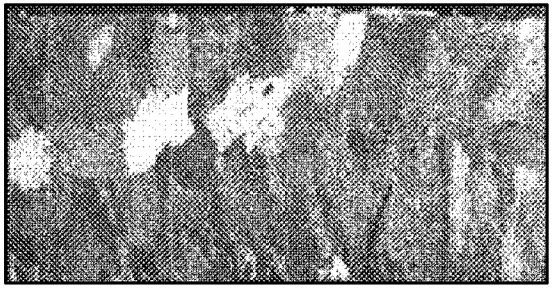
FIG. 10 (Prior Art)
FIG. 10 illustrates at 1× the equiaxed grain microstructure produced by conventional equiaxed casting.

FIG. 9 illustrates at 1× the equiaxed grain microstructure produced pursuant to the present invention as compared to FIG. 10, which illustrates at 1× the equiaxed grain microstructure produced by conventional equiaxed casting. The improvement in uniformity of grain size is apparent in FIG. 9.

Figure 11B:
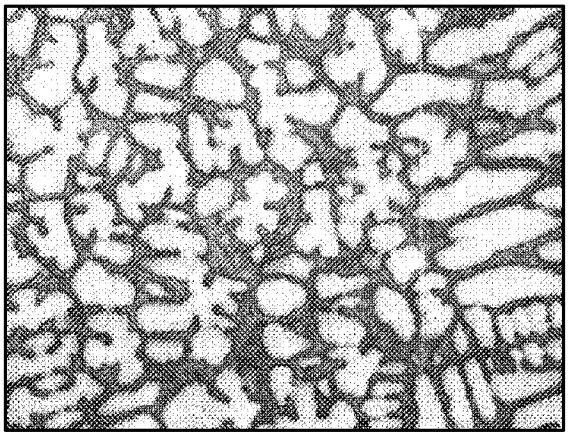
FIGS. 11A, 11B, and 11C illustrate at 50× magnification respective equiaxed grain microstructures produced by the low-superheat MX process, by practice of the present invention, and by conventional equiaxed casting.
Figure 11A:
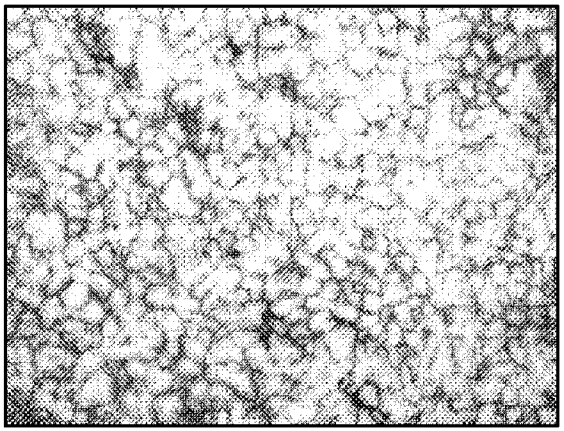
FIG. 11A (Prior Art)
Figure 11C:
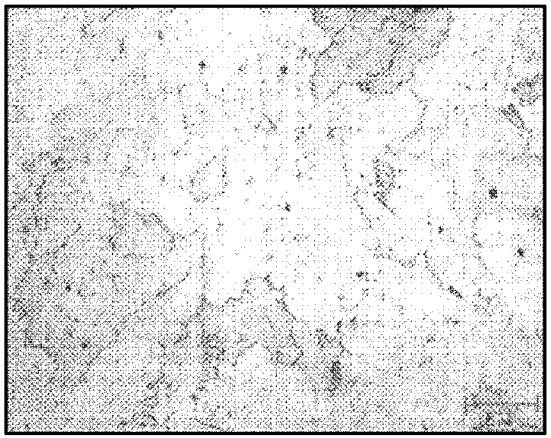
FIG. 11C (Prior Art)

FIGS. 11A, 11B, and 11C taken at 50× magnification illustrate respective equiaxed grain microstructures produced by the low-superheat MX process (U.S. Pat. No.

5,498,132), by practice of the present invention, and by conventional equiaxed casting of a nickel based superalloy, respectively. The MX-produced ASTM grain size is in the range of 2 to 5. In FIG. 11C, the conventional equiaxed casting ASTM grain size is in the range of 0 to 1. In FIG. 11B, the equiaxed ASTM grain size of a casting made pursuant to the invention is in the range of 0 to 3. In FIGS. 11A, 11B, 11C, the casting is comprised of nickel based superalloy.

Figure 12:
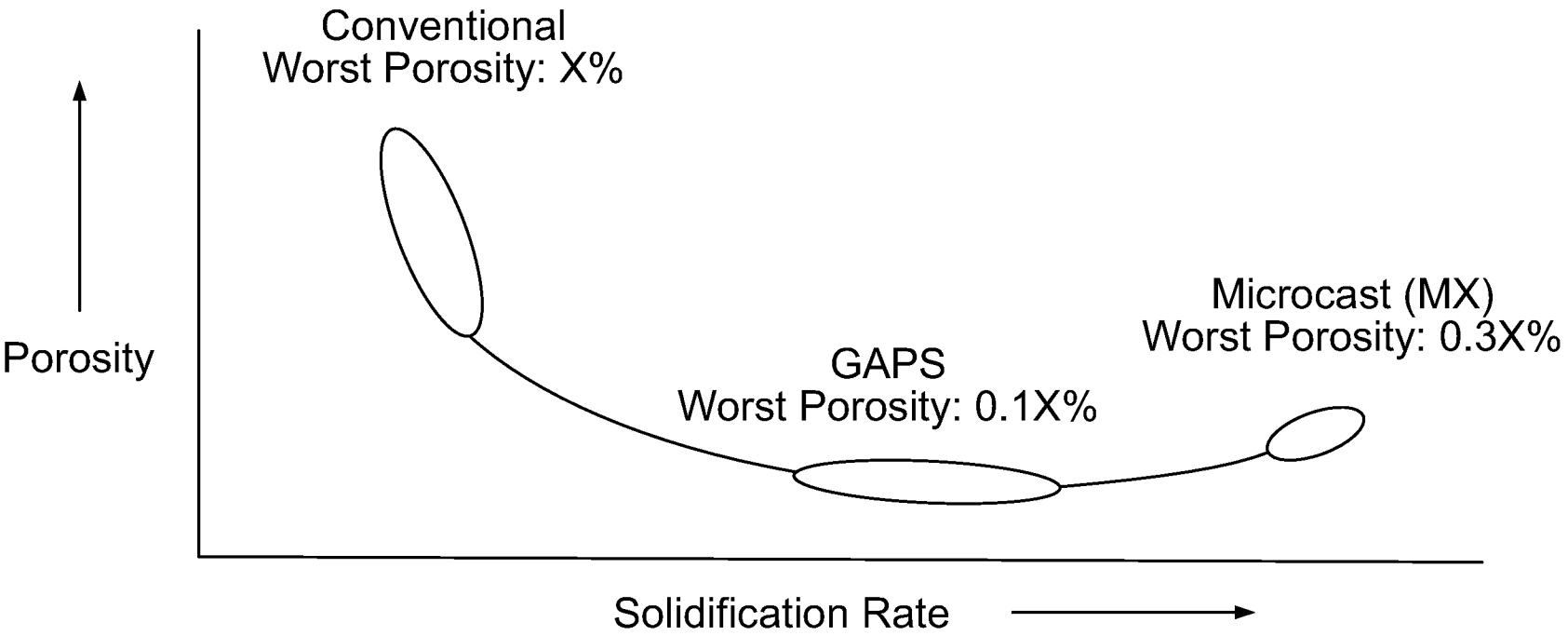
FIG. 12 is a graph schematically illustrating exemplary casting porosity versus solidification rate produced by conventional equiaxed casting, by practice of the present invention, and by the MX process.

FIG. 12 is a graph schematically summarizing exemplary casting porosity versus solidification rate produced by conventional equiaxed casting where "x %" represents a typical porosity level, by practice of the present invention (GAPS), and by the MX process. It can be seen that the process pursuant to the invention produces the lowest microporosity.

Figure 13A:
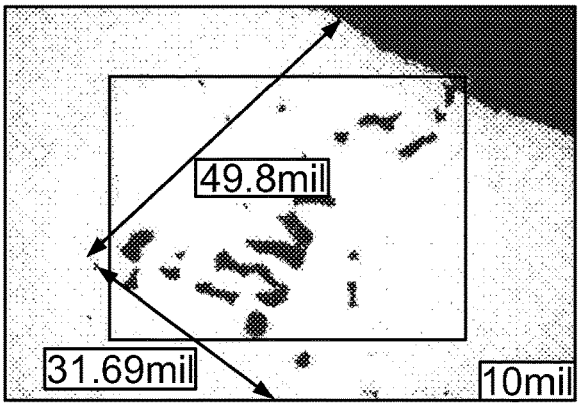
FIG. 13A (Prior Art)
FIG. 13A illustrates at magnification shown by the 10-mil scale bar localized, dendritic porosity produced by conventional equiaxed casting.
Figure 13B:
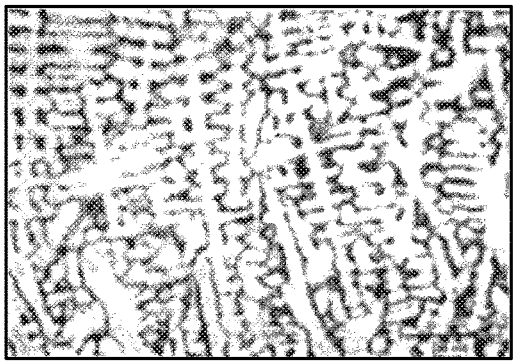
FIG. 13B illustrates at magnification shown by the 30-mil scale bar the lack of microporosity associated with practice of the present invention.
Figure 13C:
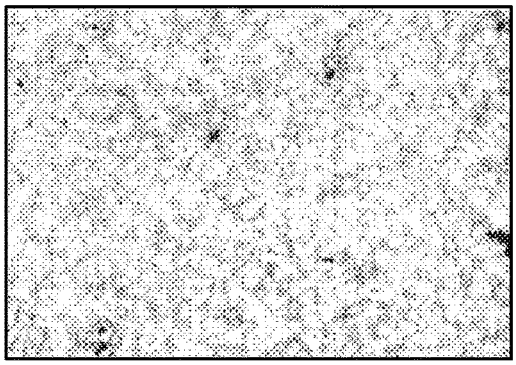
FIG. 13C (Prior Art)
FIG. 13C illustrates at 25× magnification dispersed microporosity produced by the MX process.

FIG. 13C taken at 25× magnification illustrates dispersed porosity that is present in an equaixed grain microstructure produced by the low-superheat MX process. FIG. 13A taken at magnification shown by the 10-mil scale bar illustrates localized, dendritic porosity that is present in an equiaxed grain microstructure produced by conventional equiaxed casting. FIG. 13B shows that little or no microporosity (less than 1%) is present in the equiaxed microstructure produced pursuant to the invention. In FIGS. 13A, 13B, 13C, the casting is comprised of nickel based superalloy.

Example 1

Figure 14:
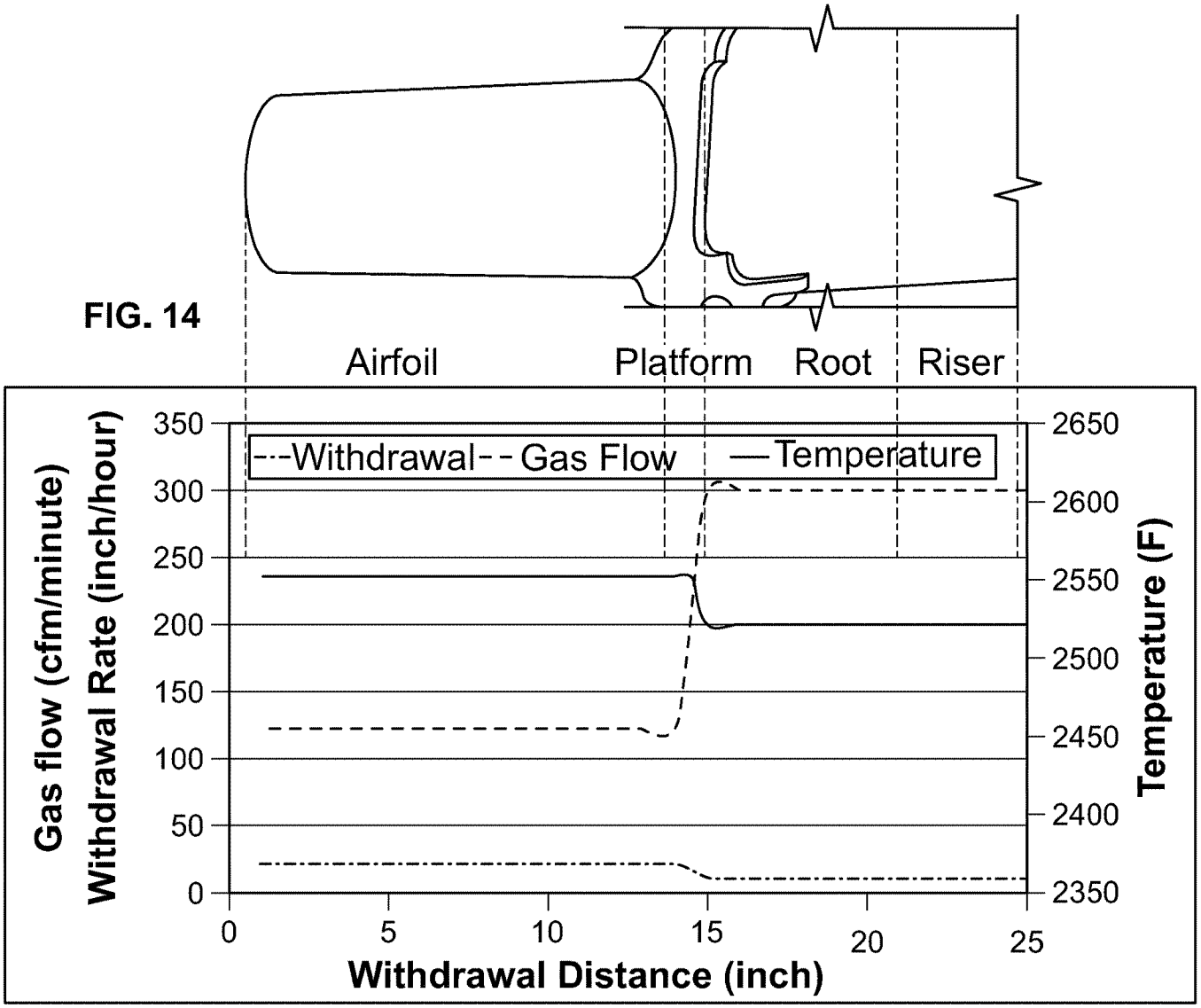
FIG. 14 is a photograph of an equiaxed grain gas turbine engine bucket made pursuant to an illustrative Example described below.

An industrial gas turbine engine bucket shown in FIG. 14 was made pursuant to an embodiment of the invention with a progressively solidified, equiaxed grain microstructure.

A casting apparatus similar to that of FIG. 4 was employed using a single shell mold of the type shown in FIG. 5 and using active cooling gas zone Z1 with fog type cooling gas discharge nozzles (5° inclination and 2 inches nozzle-to-mold average distance) and lower active cooling zone Z2 with fan type cooling gas discharge nozzles (5° inclination and 3 inches nozzle-to-mold average distance). The shell mold wall comprised twelve total layers to render it thermally conductive with the inner mold layers comprising a variety of layers of zircon and alumina dips (or zirconia, zircon, or mullite dips) with alumina or zircon stucco applied on the dips and the outer layers comprising silica dips with zircon or alumina stucco on the dips. Cooling gas zones Z1 and Z2 were located a respective distance of one inch and three inches below the furnace radiation baffle 57.

The casting parameters used to cast this mold and turbine bucket in U500 nickel base superalloy included:

Mold temperature=2525 F

Melt temperature=2625 F

Mold withdrawal speed: range of 18 inches/hour to 24 inches/hour

Cooling gas (mixture of argon with 20% helium) mass flow rate was: range of 80 cubic feet per minute to 300 cubic feet per minute (at constant argon gas pressure=120 psi) providing a cooling gas mass flow rate of 1 to 5 pounds/minute (to both zones Z1 and Z2).

Heat extraction from the metal-containing mold to progressively solidify an equiaxed grain structure along the mold length was controlled by a control algorithm generated from computer simulation solidification models and stored in a process control computer. The pre-programmed adjustments of mold withdrawal rate and cooling gas mass flow rate with almost constant mold temperature in dependence on mold withdrawal distance (using the position of mold moving ram 63) as the mold was withdrawn from the furnace are shown in FIG. 14A. The heat extraction rate was thereby controlled to maintain a substantially fixed nucleation and growth of crystals (grains) in the melt so that a uniform number of crystals and constant grain density was produced in the casting. Compared to the airfoil solidification parameters, it is apparent that, in the root region, the mold withdrawal rate is slower and the cooling gas mass flow rate is much higher to provide for increased heat extraction needed in the heavy mass of the root region.

Example 2

Figure 15:
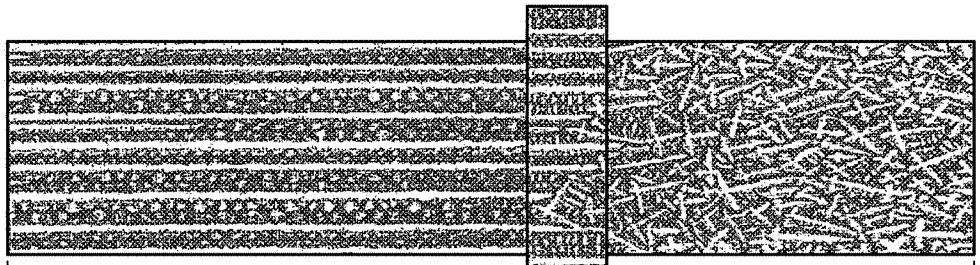
FIG. 15 is a schematic elevational view of a cast article having a dual microstructure comprising an equiaxed grain region at one end (e.g. a root region) and a columnar grain or single crystal region at another end (e.g. airfoil region).

This example is offered to illustrate production of a cast article (simulated turbine blade) pursuant to an embodiment of the invention having a dual microstructure comprising a directionally solidified (e.g. single crystal or columnar grain) airfoil region F and an equiaxed grain root region R as illustrated in FIG. 15.

The nickel base superalloy article was cast with different casting parameters for the columnar grain or single crystal airfoil region F and the equiaxed grain root region R of the simulated turbine blade. The equiaxed grain root region had a variable cross-section, such as a typical fir-tree slotted root. A ceramic shell mold having a mold cavity corresponding to the shape of the simulated turbine of FIG. 15 was cast with an open tip end of the airfoil region residing on a chill plate (like chill plate 61 of FIG. 4). A pigtail single crystal selector was embodied in the open tip end so to select a single crystal for propagation through the airfoil region of the mold cavity.

The initial casting parameters for the airfoil region of the mold were:

Mold temperature greater than 2600 F

Melt temperature greater than 2600 F

Mold withdrawal speed: 8 inches/hour

Cooling gas (mixture of argon with 20% helium) mass flow rate was: 80 cubic feet per minute (at constant argon gas pressure=120 psi) providing a cooling gas mass flow rate of 1 pound/minute to cooling zone Z1 (fan-type nozzles—10° inclination and 2.5 inches nozzle-to-mold average distance) of cooling zone Z1 and to cooling zone Z2 (fog type nozzles—5° inclination and 2.5 inches nozzle-to-mold average distance).

The subsequent casting parameters for the root region of the mold were:

Mold temperature less than 2550 F

Melt temperature greater than 2600 F

Mold withdrawal speed: 24 inches/hour

The mold temperature and thus melt temperature were reduced from greater than 2800 F to less than 2550 F by control of the induction coils of the mold heating furnace. Cooling gas (mixture of argon with 20% helium) mass flow rate was: 300 cubic feet per minute (at constant argon gas pressure=120 psi) to both zones Z1 and Z2.

Figure 15A:
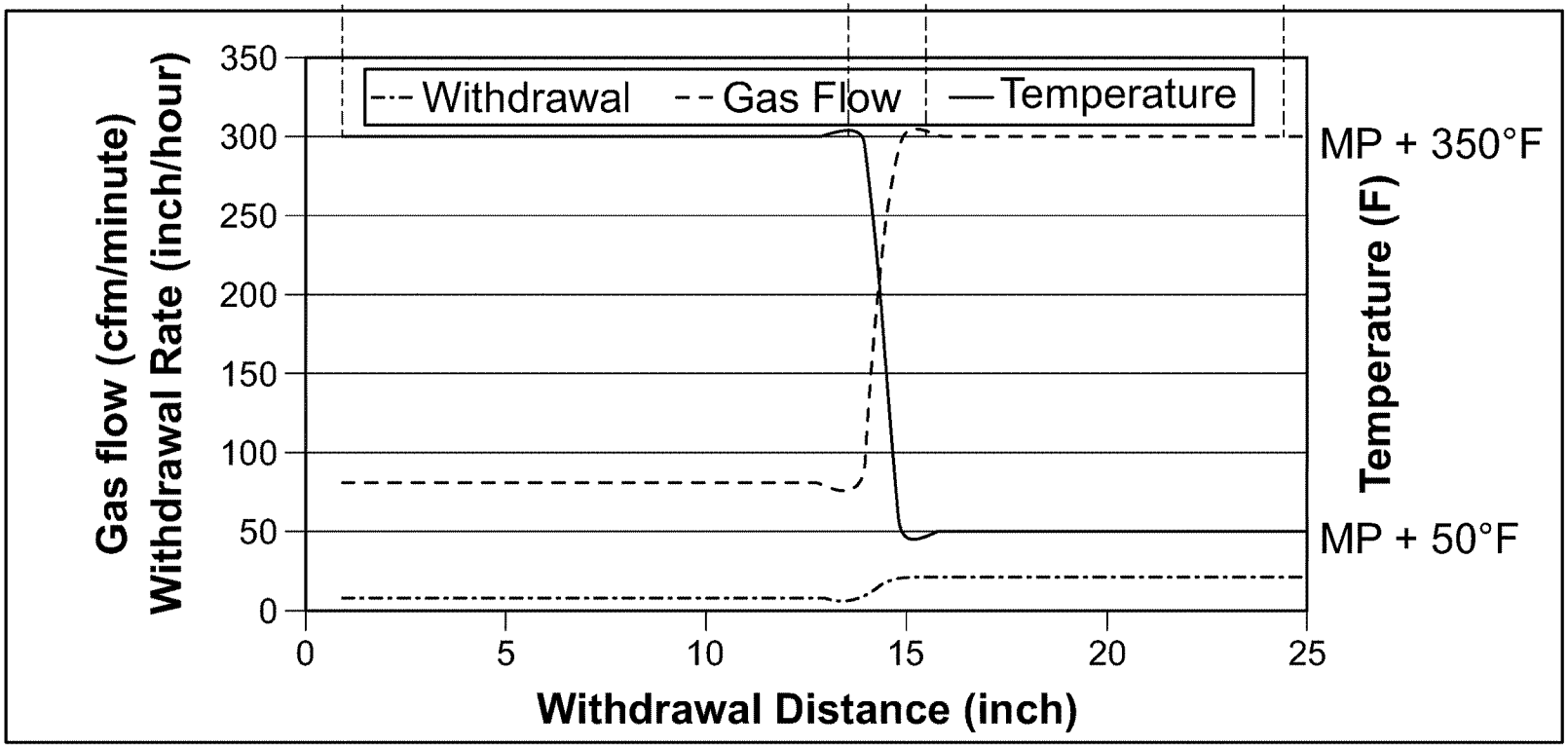
FIG. 15A is a graph illustrating varying of the mold withdrawal rate, cooling gas flow rate, and mold temperature in order to control solidification to produce the dual microstructure of the cast article of FIG. 15.

The pre-programmed adjustments of mold withdrawal rate, cooling gas mass flow rate, and mold temperature in dependence on withdrawal distance (using the position of mold moving ram 63) as the mold was withdrawn from the furnace are shown in FIG. 15A. Compared to the airfoil directional solidification (DS) parameters, it is apparent that, in the equiaxed grain root region, the mold temperature is substantially lower), the mold withdrawal rate is much higher, and the cooling gas mass flow rate is also much higher to provide much increased heat extraction needed to promote solidification of an equiaxed grain microstructure.

Although the invention has been described hereinabove in terms of specific embodiments thereof, it is not intended to be limited thereto but rather only to the extent set forth hereafter in the appended claims.

The invention claimed is:

1. A turbine component casting having a progressively solidified equiaxed grain microstructure along at least part of its length, said equiaxed grain microstructure being devoid of chill grains and columnar grains along its length.

2. The casting of claim 1, wherein the equiaxed grain microstructure is devoid of internal porosity along its length.

3. The casting of claim 1, wherein the equiaxed grain microstructure permits the casting to be solution heat treated at higher temperature without incurring incipient melting.

4. The casting of claim 1 having a different microstructure along another part of its length.

5. The casting of claim 4, wherein the different microstructure along another part of its length comprises a columnar grain or single crystal microstructure.

6. The casting of claim 1, wherein the casting includes a constant grain density.

7. The casting of claim 1, wherein the turbine component has a blade root region and a blade airfoil region, the blade root region has the equiaxed grain microstructure and the blade airfoil region has a different microstructure.

8. A turbine blade or vane casting having a varying cross-section along its length, said casting having a progressively solidified equiaxed grain microstructure along at least part of its length, said equiaxed grain microstructure being devoid of chill grains and columnar grains along its length.

9. The casting of claim 8, wherein the equiaxed grain microstructure is devoid of internal microporosity along its length.

10. The casting of claim 8, wherein the equiaxed grain microstructure permits the casting to be solution heat treated at higher temperature without incurring incipient melting.

11. The casting of claim 8, wherein the varying cross-section has a first region with a first cross-section and a second region with a second cross-section, and the first cross-section is at least two times larger than the second cross-section.

* * * * *